United States Patent [19]

Waki

[11] 4,391,533

[45] Jul. 5, 1983

[54] BACK COVER FIXING STRUCTURE FOR WRISTWATCH

[75] Inventor: Masahiko Waki, Tanashi, Japan

[73] Assignee: Citizen Watch Co. Ltd., Tokyo, Japan

[21] Appl. No.: 349,167

[22] Filed: Feb. 16, 1982

[30] Foreign Application Priority Data

Feb. 17, 1981 [JP] Japan ..... 56-21049

[51] Int. Cl.[3] ..... G04B 37/00

[52] U.S. Cl. ..... 368/281; 368/276; 368/282; 368/297; 368/309; 368/310

[58] Field of Search ..... 368/276, 281, 282, 297, 368/309, 310; 220/3.8, 327, 378

[56] References Cited

U.S. PATENT DOCUMENTS 2,224,421 12/1940 Aaron ..... 368/281
2,644,602 7/1953 Ross ..... 220/378
3,392,228 7/1968 Zerwes ..... 220/3.8
3,910,031 10/1975 Keida ..... 368/281

FOREIGN PATENT DOCUMENTS 613591 10/1979 Fed. Rep. of Germany ..... 368/309
935180 8/1963 United Kingdom ..... 220/327

*Primary Examiner*—Ulysses Weldon
*Attorney, Agent, or Firm*—Koda and Androlia

[57] ABSTRACT

A back cover fixing structure for a wristwatch, which comprises a case band having a plurality of inwardly projecting portions provided on an inner wall of the case band and screw holes provided in respective ones of the inwardly projecting portions, a back cover having a plurality of through-holes, and a plurality of screws set in the screw holes of the case band through the through-holes of the back cover for fixing the back cover to the case band.

5 Claims, 7 Drawing Figures

BACK COVER FIXING STRUCTURE FOR WRISTWATCH

BACKGROUND OF THE INVENTION

1. Field of the Invention

This invention relates to a watch case and, more particularly, to a structure for fixing a back cover of a wristwatch.

2. Prior Art

In a conventional structure for fixing a back cover, the back cover is press-fitted into a case band of the wristwatch. This conventional structure depending upon simply mechanical attachment cannot maintain the fixing force of the back cover for long periods of use. Especially, a thickness of a fixing portion of the back cover cannot be sufficiently prepared in a thin wristwatch, therefore, the fixing force of the back cover is not sufficient for sealing between the back cover and the case band.

In another conventional structure for fixing a back cover, the back cover having a male screw portion at the outer periphery thereof is screwed into the case band having a female screw portion at the inner circumference thereof. It is necessary to prepare a thick back cover and case band for forming the male and female screw portions in the structure. Thus, the watch case is thick and large, and providing a thin watch case is difficult. Further, the watch case including the back cover having the male screw portion and the case band having the female screw portion must be formed in a circular form, therefore, the form of the watch case is limited to the circular form and the like.

The watch case of the wristwatch, for which an attractive appearance is essential, has grown thinner and smaller in size, in recent years. However, it is difficult to accomplish the thin watch case having a simple construction and a stable waterproof by using the structures of the above-mentioned prior art.

On this account, a structure for fixing the back cover by screws has come into widespread use. This structure is simple in construction, easy to manufacture and exhibits a stable waterproof seal. Further, such a structure is advantageous in terms of providing an attractive external appearance, and in terms of thickness and size reduction.

SUMMARY OF THE INVENTION

It is, therefore, an object of the present invention to provide a back cover fixing structure for a wristwatch which can overcome the shortcomings encountered in the prior arts.

It is another object of the present invention to provide a back cover fixing structure for a wristwatch which provides size and thickness reduction and exhibits an external appearance of high-quality.

In keeping with the principles of the present invention, the above-mentioned objects are accomplished by a back cover fixing structure for a wristwatch, comprising: a case band having a plurality of inwardly projecting portions provided on an inner wall of said case band, each of said inwardly projecting portions having a screw hole; a back cover having a plurality of through-holes provided at positions corresponding to the screw holes of said inwardly projecting portions; and a plurality of screws set in the screw holes of said inwardly projecting portions through the through-holes of said back cover for fixing said back cover to said case band.

BRIEF DESCRIPTION OF THE DRAWINGS

These and other objects, features and advantages of the present invention will become more apparent from the following description when taken in conjunction with the accompanying drawings, in which:

FIG. 1 to FIG. 3 illustrate an example of the prior art, in which FIG. 1 is a sectional view, FIG. 2 is a back view, and FIG. 3 is a sectional view taken on line III—III of FIG. 2; and FIG. 4 to FIG. 7 illustrate an embodiment of the present invention, in which FIG. 4 is a sectional view, FIG. 5 and FIG. 6 are back views, and FIG. 7 is a sectional view taken on line VII—VII of FIG. 5.

DETAILED DESCRIPTION OF THE INVENTION

Figure 1:
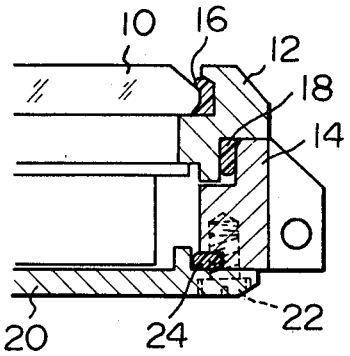
Fig. 1 PRIOR ART

FIG. 1 shows an example of a conventional back cover fixing structure. Reference numeral 10 denotes a watchglass, 12 a bezel, and 14 a case band. A packing 16 is disposed between the watchglass 10 and bezel 12, and a packing 18 between the bezel 12 and case band 14. These packings 16 and 18 are secured in place by screw 22 and compresses an O-ring 24. The screw 22 is one of four screws which are provided at four corners of the back cover 20.

Figure 2:
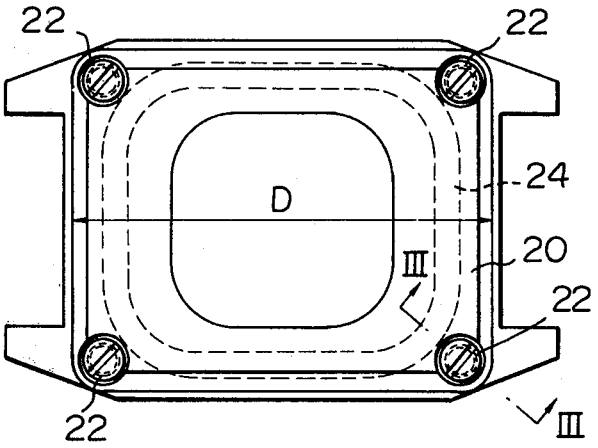
Fig. 2 PRIOR ART

FIG. 2 is a back view of the conventional structure shown in FIG. 1. The screw 22 is provided at each of the four corners of the back cover 20. Each of the screws 22 is provided outside the O-ring 24. This structure is disadvantageous in that the back cover 20 must be elongated (especially in the direction D) since the through-holes for inserting the screws 22 are provided outside the O-ring 24. Thus, a space is required at each of the four corners of the back cover 20 in order to provide the screws as above, whereby the four corners of the back cover 20 markedly protrude from the outline of the O-ring 24. Thus, it is impossible to provide the back cover having the same shape as the watch dial and the profile of the watch, thereby detracting form the appearance of the wristwatch.

Figure 3:
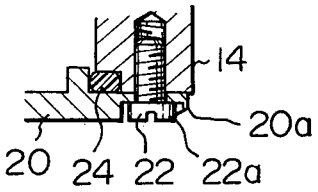
Fig. 3 PRIOR ART

FIG. 3 is a sectional view taken on line III—III of FIG. 2 showing the conventional structure. In FIG. 3, when it is attempted to provide the outer circumference of the back cover 20 with an inclined surface 20*a* to improve the appearance, the head portion 22*a* of the screw 22 protrudes from the inclined surface 20*a* of the back cover 20. The head portion 22*a* of the screw 22 is unattractive and may scratch the wearer's skin. It is necessary to provide the inclined surface 20*a* outside the area occupied by the screw 22 for solving these problems. In other words, this necessitates a further increase in the diameter of the back cover 20, therefore, the size of the watch case becomes large.

The present invention seeks to overcome the above-mentioned shortcomings encountered in the prior art by means of a back cover fixing structure in which screw holes provided in a case band for screwing the back cover are located inside the inner wall of an O-ring, and in which independent packing members are disposed in the screw holes. This structure is outstanding in terms of size and thickness reduction as well as in terms of external appearance.

Figure 4:
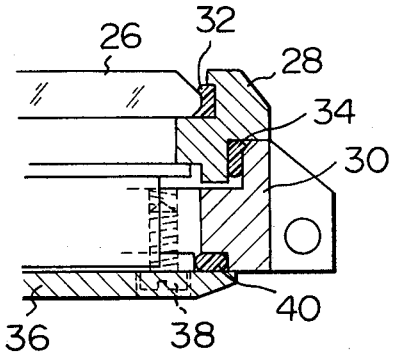

FIG. 4 is a sectional view of an embodiment of the present invention. Reference numeral 26 denotes a watchglass, 28 a bezel, and 30 a case band. A packing 32 is disposed between the watchglass 26 and bezel 28, and a packing 34 is disposed between the bezel 28 and case band 30. These packings 32 and 34 are secured in place to provide a waterproof seal. A back cover 36 is secured in place by a screw 38 and compresses an O-ring 40 between itself and the case band 30. The screw 38 is one of four screws which are provided for fixing the back cover 36 to the case band 30.

Figure 5:
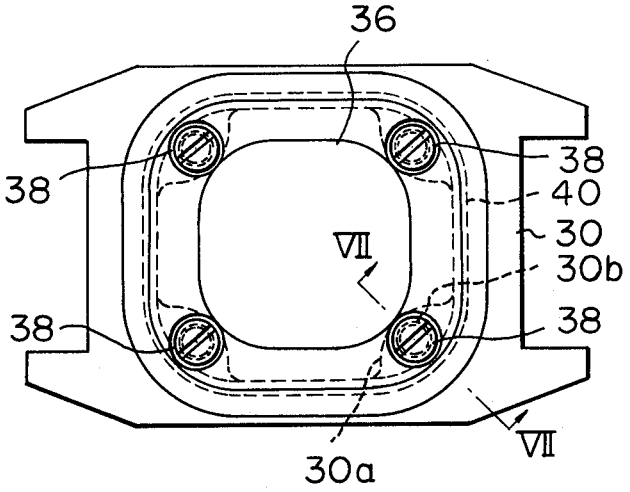

FIG. 5 is a back view of the structure of the present invention shown in FIG. 4. In FIG. 4, the screws 38 are located inside the O-ring 40. Each of the screws 38 is set in a screw hole **30*b* provided in the inwardly projecting portion 30*a* of the case band 30. In general, there exists a space between the inner circumference of the case band and the movement. According to the present invention, the four inwardly facing corners of the case band 30 are projected inwardly for forming the inwardly projecting portions 30*a*** by using said available space.

Figure 6:
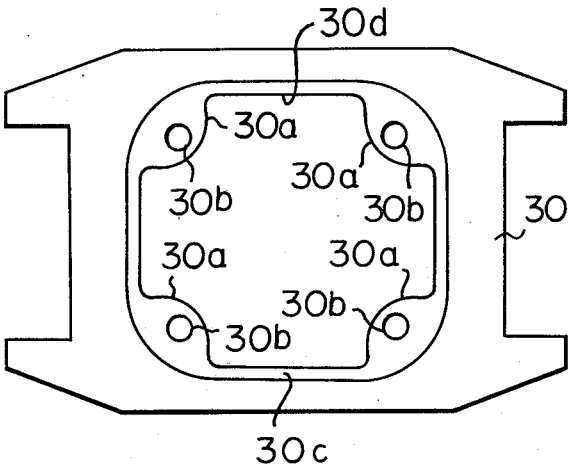

FIG. 6 is a back view of the case band shown in FIG. 5. The case band 30 includes a movement hole **30*d* for accommodating the movement, the inwardly projecting portion 30*a* provided at the four corners of an inner wall of the case band 30, in which the inwardly projecting portions 30*a* project inwardly toward a center of the movement hole 30*d* of the case band and a step portion 30*c* provided between the inwardly projecting portions 30*a* and an outer wall of the case band 30**.

Figure 7:
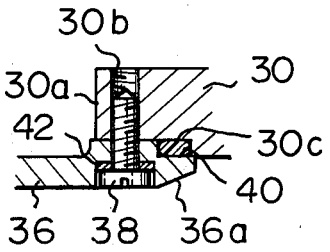

FIG. 7 is a partially sectional view taken on line VII—VII of FIG. 5 showing the structure of the present invention. Reference numeral 42 denotes a packing sandwhiched between the back cover 30 and screw 38 for sealing the screw portion. The screw 38 is located inside the O-ring 40, whereby an inclined surface **36*a* can be formed outside the area occupied by the screw 38 without enlarging the diameter of the back cover 36**.

It will now be appreciated from the foregoing description that in accordance with the present invention a case band has inwardly projecting portions inside an O-ring and screws for fixing a back cover are set in a screw hole provided at each of the inwardly projecting portions whereby it is possible to locate the screws closer to the center of the back cover so that the outer diameter of the back cover can be greatly reduced.

It should also be understood that since the screws are located closer to the center of the back cover, the inclined surface of the back cover which produces the better appearance can be enlarged only to make the back cover more attractive. Further, since the heads of the screw can be completely recessed within the back cover, this not only presents an attractive appearance but also prevents the wearer's skin from being scratched by the protruding screw heads as in the prior art arrangement.

I claim:

1. A back cover fixing structure for a wristwatch comprising:

a case band having an inner wall and an outer wall and having a plurality of projecting portions on said inner wall, in which said projecting portions project inwardly toward a center of said case band, each of said inwardly projecting portions having a screw hole;

a back cover having a plurality of throughholes provided at positions corresponding to the screw holes of said inwardly projecting portions; and a plurality of screws set in the screw holes of said inwardly projecting portions through the throughholes of said back cover for fixing said back cover to said case band.

2. A back cover fixing structure according to claim 1, further comprising an O-ring provided in a step portion of said case band for supporting said O-ring, said step portion being provided between said inwardly projecting portions and said outer wall.

3. A back cover fixing structure according to claim 2, further comprising a plurality of packings provided between said back cover and said screws.

4. A back cover fixing structure according to claim 1, in which said back cover has an inclined surface provided at an outer circumference of said back cover outside an area occupied by said screws.

5. A back cover fixing structure according to claim 1, in which said inwardly projecting portions are projected from four inwardly facing corners of said case band.

* * * * *